US006338537B1

(12) United States Patent
Nou

(10) Patent No.: US 6,338,537 B1
(45) Date of Patent: Jan. 15, 2002

(54) HEAD DRIVE CIRCUIT AND INKJET PRINTER HAVING THE SAME

(75) Inventor: Hiroshi Nou, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/417,768

(22) Filed: Oct. 14, 1999

(30) Foreign Application Priority Data

Jan. 8, 1999 (JP) ..... 11-003153

(51) Int. Cl.[7] ..... B41J 29/38
(52) U.S. Cl. ..... 347/9
(58) Field of Search ..... 347/9, 10, 12, 347/11, 14, 23, 19, 15

(56) References Cited

U.S. PATENT DOCUMENTS 6,068,360 A * 6/1998 Hiwada ..... 347/14

FOREIGN PATENT DOCUMENTS

| | | |
|---|---|---|
| DE | 39 24 966 A1 | 1/1991 |
| EP | 0 835 757 A2 | 4/1998 |
| WO | WO 95/328865 A1 | 12/1995 |

OTHER PUBLICATIONS

Patent Abstract of Japan No. 9–076485, dated Mar. 25, 1997.
Patent Abstract of Japan No. 8–187854, dated Jul. 23, 1996.
Patent Abstract of Japan No. 62–278047, dated Dec. 2, 1987.
Patent Abstract of Japan No. 58–208064, dated Dec. 3, 1983.
Patent Abstract of Japan No. 61–27261, dated Feb. 6, 1986.

* cited by examiner

*Primary Examiner*—John Barlow
*Assistant Examiner*—Charles W. Stewart, Jr.
(74) *Attorney, Agent, or Firm*—Armstrong, Westerman, Hattori, McLeland & Naughton, L.L.P.

(57) ABSTRACT

It is an exemplified object of the present invention is to provide an inkjet printer having a head drive circuit that can generate a less distorted drive waveform stably using a smaller-size and smaller-capacitance transistor than the conventional. An inkjet head of the present invention comprises a head which includes a plurality of piezoelectric elements and may jet ink using the piezoelectric elements, a carriage which has the head and moves with the head, and a one-chip head drive circuit, provided in the carriage, which receives a control signal and a drive signal for driving the piezoelectric elements, and drives the head, wherein the head drive circuit includes a plurality of selection parts, connected to each of the piezoelectric elements, which may receive the drive signal, a control part, coupled to the selection parts, which controls the selection parts based on the control signal, and selects a piezoelectric element to be driven from among the piezoelectric elements, and a plurality of current amplifier parts, provided in every selection part and piezoelectric element, which amplify the drive signal to be supplied to the piezoelectric element to be driven. The current amplifier part in the head drive circuit is provided for each piezoelectric element without requiring a large-size transistor seen in the prior art.

10 Claims, 11 Drawing Sheets

HEAD DRIVE CIRCUIT AND INKJET PRINTER HAVING THE SAME

BACKGROUND OF THE INVENTION

The present invention generally relates to printers, and more particularly to a drive system for use with a printing head (i.e., inkjet head) in an inkjet printer. The head drive system of the present invention is applicable not only to a single printer unit but also to an inkjet head which is widely usable for those copy machines, facsimile machines, computer systems and word processors, and combination machines thereof which have a printing function.

Among inkjet heads those which employ a piezoelectric element have increasingly come into the limelight in recent years due to its excellency in energy efficiency. This type of inkjet head generally includes a piezoelectric element, one common ink chamber which receives from an external device and stores ink, a plurality of pressure chambers coupled to the piezoelectric element, and a nozzle plate so connected to the pressure chambers that one nozzle may be connected to each pressure chamber. Each pressure chamber is connected to the common ink chamber through an ink introduction channel so that it may receive ink from the common ink chamber and increase its internal pressure using deformation of the piezoelectric element, thereby jetting ink from each nozzle. As a consequence, the inkjet head prints characters and images on a recording medium such as a printing paper.

One piezoelectric clement may be allocated to each pressure chamber (i.e., each nozzle), or may be allocated to all the pressure chambers while each pressure chamber is assigned to each of piezoelectric blocks as a divided piece in the piezoelectric element. A piezoelectric element or piezoelectric block (hereinafter simply called "piezoelectric element") allocated to each pressure chamber may deform independently of those assigned to other pressure chambers, and thus each nozzle can jet ink independently of other nozzles.

Each piezoelectric element is typically comprised of a capacitive load containing a capacitor. Conventionally these piezoelectric elements have been connected commonly to and driven by a single drive control part. While the drive control part serves to generate and amplify a drive waveform, its amplifier part includes a bulk-size and large-capacitance transistor that requires high drive voltage and current so as to allow all the piezoelectric elements to drive simultaneously. The drive waveform determines a deformation amount of each piezoelectric element, and thus the drive circuit will in the event decide an ink-drop jet amount and speed, and ultimately the image quality.

A conventional inkjet printer has a disadvantage in that the drive control part often generates a distortional drive waveform and cannot provide high quality images. The recent demand for high-resolution images has more and more increased the number of nozzles and piezoelectric elements in an inkjet head, but this inventor has discovered that the distortional drive waveform accounts for the increased number of piezoelectric elements to be simultaneously driven.

A piezoelectric element as a capacitive load exposes itself to a sudden voltage chance and a large charge current especially at the time of ink jetting. This sudden change brings about distortion, and deteriorates the image quality as the number of piezoelectric elements increases. In addition, a push-pull circuit in the amplifier part in the drive control part when connected to a capacitive load is apt to oscillate.

A push-pull circuit, which includes a pair of PNP and NPN transistors for use with power amplifications and impedance conversions, makes difficult such a circuit design of the amplifier part that operates stably for all combinations of driven piezoelectric elements. Oscillation in the push-pull circuit would distort a drive waveform and print undesired images. Moreover, a flexible cable which is connected to the drive control part and the head needs to flow a high-current and high-voltage drive waveform over a long distance, and its resistance and inductance components cause a voltage drop and distortion in the drive waveform.

On the other hand, a piezoelectric element has become more and more miniaturized, and drive voltage and current for driving each piezoelectric element have become reduced. Even a practical application is less likely to require all the piezoelectric elements to drive at the same time. Therefore, the present inventor has found that the conventional structure is uneconomical using a bulk transistor to drive a small number of piezoelectric elements.

SUMMARY OF THE INVENTION

Therefore, it is an exemplified general object of the present invention to provide a novel and useful inkjet head and its manufacturing method in which the above disadvantages are eliminated.

Another exemplified and more specific object of the present invention is to provide an inkjet printer having a head drive circuit that can generate a less distorted drive waveform stably using a smaller-size and smaller-capacitance transistor than the conventional.

In order to achieve the above objects, an inkjet printer of one aspect of the present invention comprises a head which includes a plurality of piezoelectric elements and may jet ink using the piezoelectric elements, a carriage which has the head and moves with the head, and a one-chip head drive circuit, provided in the carriage, which receives a control signal and a drive signal for driving the piezoelectric elements, and drives the head, wherein the head drive circuit includes a plurality of selection parts, connected to each of the piezoelectric elements, which may receive the drive signal, a control part, coupled to the selection parts, which controls the selection parts based on the control signal, and selects a piezoelectric element to be driven from among the piezoelectric elements, and a plurality of current amplifier parts, provided in every selection part and piezoelectric element, which amplify the drive signal to be supplied to the piezoelectric element to be driven.

An inkjet printer of another aspect of the present invention comprises a head which includes a plurality of piezoelectric elements and may jet ink using the piezoelectric elements, and a head drive circuit that receives a control signal and those plural types of drive signals which drive the piezoelectric elements, and drives the head, wherein the head drive circuit includes a plurality of selection parts, connected to each of the piezoelectric elements, which may receive each of the plural types of drive signals, a control part, coupled to the selection parts, which controls the selection parts based on the control signal, and selects a piezoelectric element to be driven from among the piezoelectric elements and a drive signal to be used from among the drive signals, and a plurality of current amplifier parts, provided in every selection part and piezoelectric element, which amplify the drive signal to be supplied to the piezoelectric element to be driven. Such an inkjet printer is suitable for multi-gradation and/or color inkjet printers.

A head drive circuit of the present invention that receives a control signal and those plural types of drive signals for driving piezoelectric elements and which drives the piezoelectric elements in a head, the head including the plurality of piezoelectric elements and being able to jet ink using the piezoelectric elements, comprises a plurality of selection parts, connected to each of the piezoelectric elements, which may receive each of the plural types of drive signals, a control part, coupled to the selection parts, which controls the selection parts based on the control signal, and selects a piezoelectric element to be driven from among the piezoelectric elements and a drive signal to be used from among the drive signals, and a plurality of current amplifier parts, provided in every selection part and piezoelectric element, which amplify said drive signal to be supplied to said piezoelectric element to be driven.

A one-chip head drive circuit of one aspect of the present invention that receives a control signal and a drive signal for driving piezoelectric elements in a head and which drives the piezoelectric elements, the head including the plurality of piezoelectric elements and being able to jet ink using the piezoelectric elements, comprises a plurality of selection parts, connected to each of the piezoelectric elements, which may receive each of the drive signals, a control part, coupled to the selection parts, which controls the selection parts based on the control signal, and selects a piezoelectric element to be driven from among the piezoelectric elements, and a plurality of current amplifier parts, provided in every selection part and piezoelectric element, which amplify the drive signal to be supplied to the piezoelectric element to be driven.

The inkjet printers and head drive circuits of the present invention require no bulk-sized transistors seen in the prior art, because each piezoelectric element is equipped with one current amplifier part in the head drive circuit. In addition, the head drive circuit may include a voltage amplifier part that is commonly connected to each current amplifier part, thereby reducing the number of voltage amplifier parts in comparison with current amplifier parts each having a voltage amplifier part.

Other objects and further features of the present invention will become readily apparent from the following description of the embodiments with reference to accompanying drawings.

DETAILED DESCRIPTION OF PREFERRED EMBODIMENTS

Figure 1:
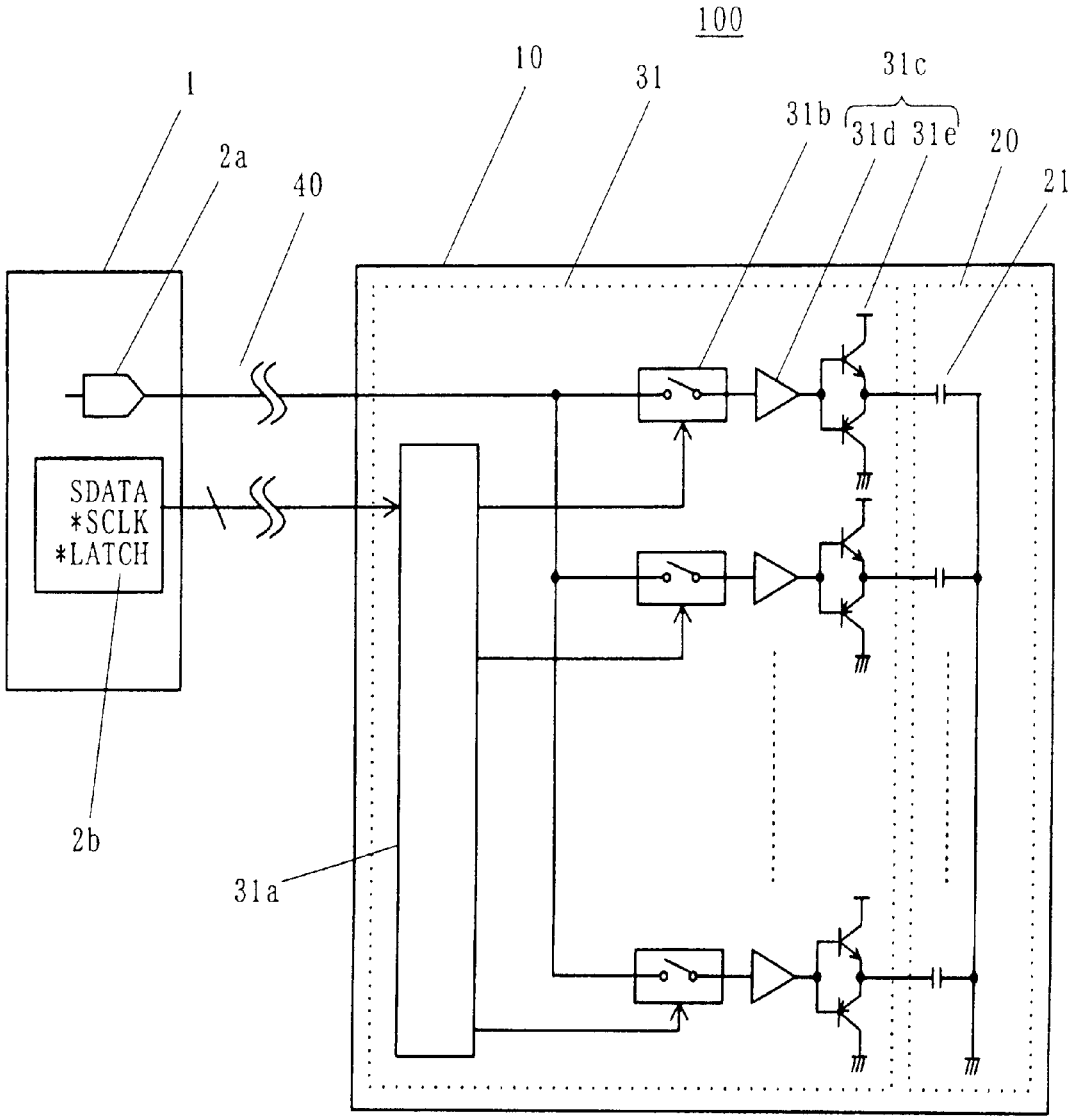
FIG. 1 is a circuit diagram that shows a drive system of a first embodiment of this invention.

A description will now be give of drive system 100 of a first embodiment according to the present invention, with reference to FIGS. 1 through 8. Those elements in each drawing, which are designated by the same reference numerals, denote the same elements, and a duplicate description thereof will be omitted. Those elements, which are designated by the same reference number and an alphabetical letter, denote corresponding elements. Hereupon, FIG. 1 is a circuit diagram that shows the drive system 100 of the present invention.

As shown in FIG. 1, the drive system 100 exemplarily includes controller 1 placed on a motherboard of an inkjet printer and connected to a host computer (not shown), carriage 10 mounted with a movable head, and flexible cable 40 that connects carriage 10 to controller 1 in a movable manner.

The controller 1 has waveform generating part 2*a* and control-signal generating part 2*b*. The waveform generating part 2*a* generates a certain drive waveform signal based upon instructions (digital data) from the host computer (not shown). The control-signal generating part 2*b* generates a control signal and supplies it to control part 31*a* that will be described later. The control signal exemplarily comprises a 64-bit serial data signal (SDATA) for selections of image data and each piezoelectric element that will be described later, a serial clock signal (SCLK) for synchronous timing, and a latch signal (LATCH) indicating termination.

The carriage 10 has head 20 and head drive circuit 31, while the head 20 has a plurality of piezoelectric elements. Each piezoelectric element 21 is represented as a capacitive load that is comprised of a capacitor in FIG. 1. Therefore, a large current flows the instant that a drive voltage is applied to each piezoelectric element 21.

The head drive circuit 31 has control part 31*a*, drive waveform selection parts 31*b*, drive waveform amplifier parts 31*c*, voltage amplifiers 31*d*, and current amplifiers 31*e*. The control part 31*a* receives a control signal from the control-signal generating part 2*b* in the controller 1, and controls the drive waveform selection parts 31*b*. Each drive waveform selection part 31*b* includes, for example, a switching element. Each drive waveform selection part 31*b* includes the voltage amplifier parts 31*d* and the current amplifiers 31*e*. The voltage amplifier part 31*d* amplifies waveform generating part 2*a*-generated drive waveform signals (e.g., 10 V or so) up to a voltage (e.g., 40 V or so) necessary to drive each piezoelectric element 21. The voltage amplifier part 31*d* may employ any known voltage amplifier circuit.

The current amplifier 31*e* uses a push-pull circuit that includes a pair of PNP and NPN transistors for power amplifications and impedance conversions. In the drive system 100 of the present invention, each current amplifier 31*e* characteristically manages only one piezoelectric element 21. This configuration enables the inventive drive system 100 to achieve the following effects.

First, the drive system 100 of the instant invention is more economical and efficient than the conventional inkjet head.

A conventional push-pull circuit has used such a large-sized and large-capacitance transistor that allow all the piezoelectric elements to drive at the same time, where one current amplifier 31*e* manages multiple piezoelectric elements. Such a large-sized and large-capacitance transistor is costly, and all the piezoelectric elements are rarely driven at the same time. The conventional structure thus appears to be uneconomical. The present invention enables to use a small-sized and small-capacitance transistor, and resolves these problems. Such a transistor preferably includes an IC and a transistor array.

Second, the drive system 100 of the present invention may provide higher quality images in a more stable operation than the conventional inkjet head. The push-pull circuit features high-input and low-output impedance, and is generally used as a current-supplying drive circuit. However, the push-pull circuit 31*e* may disadvantageously oscillate, when connected to a capacitive load, due to a positive feedback via the parasitic capacitance inside the transistor or a cable. A condition of oscillation depends upon the load capacitance, other circuit constants, circuit parasitic capacitance, etc. Thus, piezoelectric elements, i.e., a plurality of capacitive loads, when connected to the push-pull circuits 31*e* as in the conventional arrangement, preclude such a circuit design that each push-pull circuit 31*e* may stably operate for all combinations of simultaneously driven piezoelectric elements. As a result, a drive waveform may possibly include a distortion depending on the number of simultaneously driven piezoelectric elements. Connecting only one capacitive load to each push-pull circuit, the present invention facilitates a stable circuit design that prevents oscillation, thereby solving the conventional disadvantages.

The flexible cable 40, when applied to the conventional circuitry, has transmitted a high-current and high-voltage drive waveform, and caused a voltage drop and a distortion in a drive waveform due to its resistance and/or inductance components. On the other hand, a configuration of the inventive drive system 100 has an advantage in that the flexible cable 40 transmits only power and a weak signal such as a drive waveform and control signals (e.g., SDATA, SCLK and LATCH), holding down a voltage drop and distortion in a drive waveform that are caused by its resistance and/or inductance components.

Figure 2:
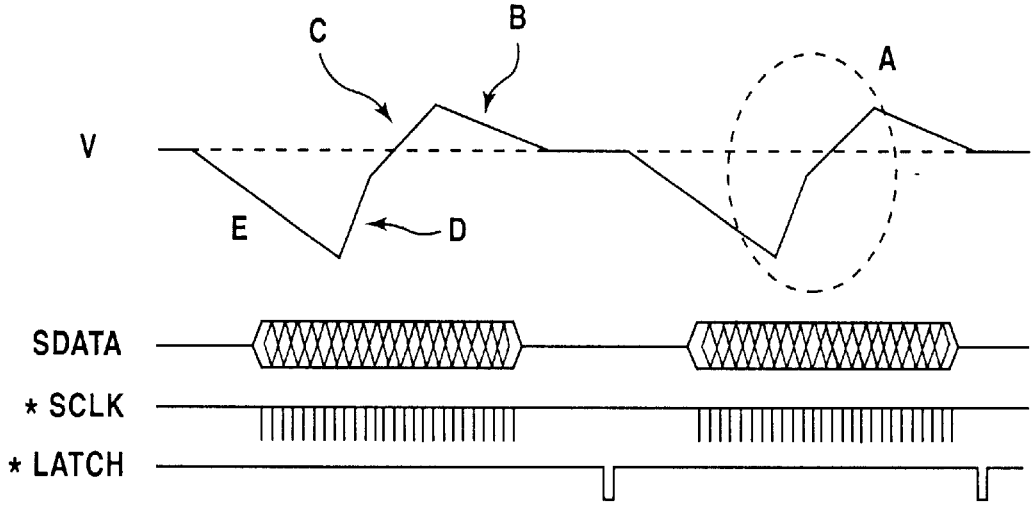
FIG. 2 is an exemplified timing chart of a control signal and drive waveform for use with the head drive circuit shown in FIG. 1.

Next follows an operation of the drive system 100. FIG. 2 shows an exemplified timing chart of drive waveform V that the waveform generating part 2*a* generates and the control signal (SDATA, SCLK, and LATCH) that the control-signal generating part 2*b* generates. The drive waveform V that the waveform generating part 2*a* generates is an exemplified drive waveform used to jet 10 pico-litters (pl) of ink drops, and part A in the waveform will be further detailed in an enlarged manner later. In the waveform, part B serves to pull in a meniscus (namely, hold down a meniscus residual oscillation) to reduce a fluctuation in repeatedly jetted ink drop amount. Part C is a start-up part for the part B. Part D is where an ink drop is jetted, but stops a deformation of the piezoelectric element 21 in the middle to reduce a drop amount. Part E is part that brings in ink to be jetted.

Figure 3:
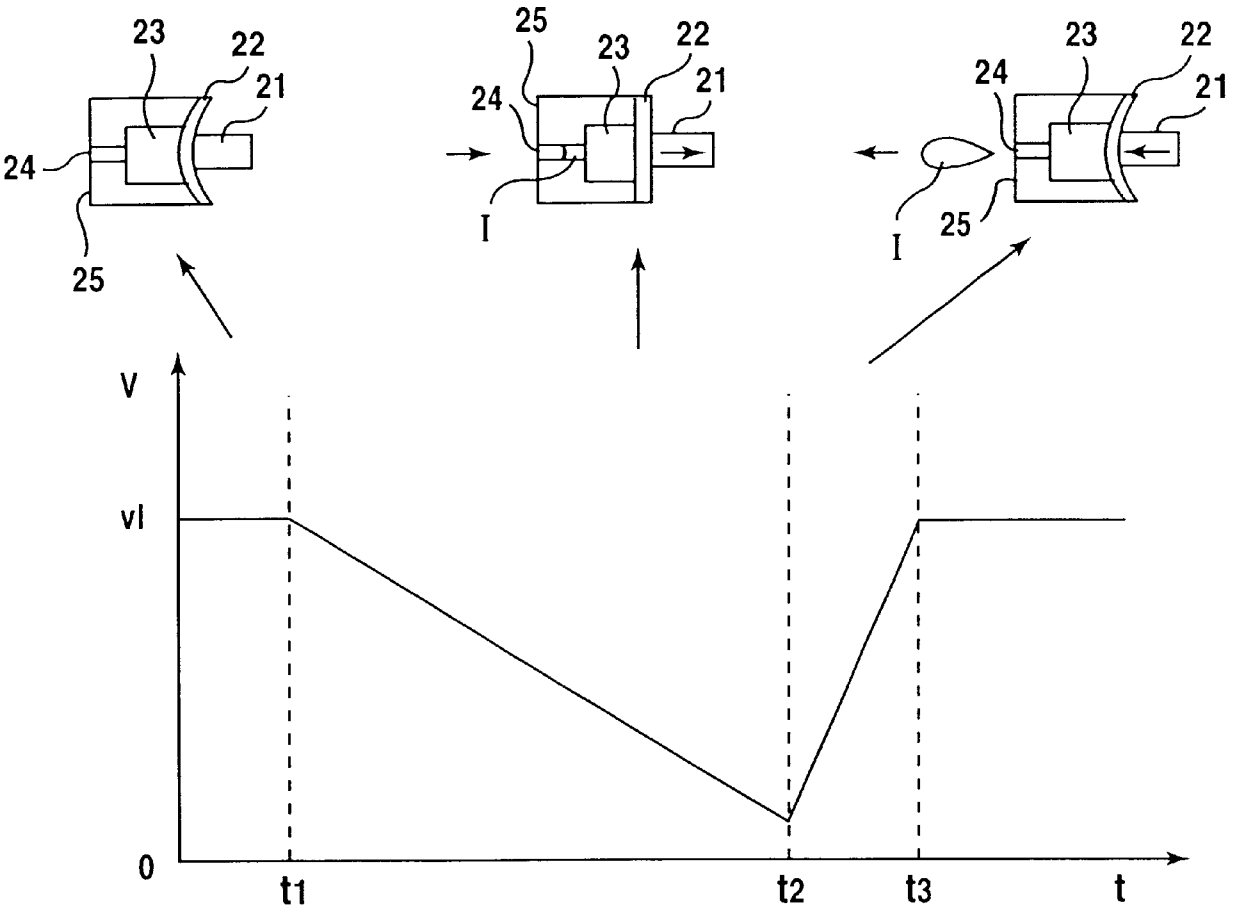
FIG. 3 is a view showing a drive waveform and operation of the piezoelectric elements supplied with the drive waveforms.

A detailed description of continuous ink jets will be given, with reference to FIG. 3. FIG. 3 shows a drive waveform and an operation of a piezoelectric element that is supplied with this drive waveform. The drive waveform has time t as an abscissa and voltage v as an ordinate in FIG. 3. Also illustrated on this drive waveform diagram are actions of the inkjet head in each section. In section between 0 and $t_1$, constant base voltage vi (e.g., 22V) is applied to (the not-shown external electrode in) the piezoelectric element 21, and the piezoelectric element 21 deforms and compresses the pressure chamber 23 via the thin film 22. At this time, the ink surface position (meniscus) in the nozzle 24 levels with a surface of nozzle plate 25.

In section between $t_1$, and $t_2$ that corresponds to the part E in FIG. 2, the drive voltage gradually decreases from the base voltage vi to about 0V, for example, and the piezoelectric element 21 tries to recover its original state. This recovery absorbs ink into the nozzle 24. Lastly in section between $t_2$ and $t_3$ that corresponds to the part D in FIG. 2, the drive voltage again increases up to, for instance, 15 V or so in a short time, and the piezoelectric element 21 again deforms and compresses the pressure chamber 23 via the thin film 22, thereby jetting ink I through the nozzle 24. The continuous ink jets need the parts C and B in FIG. 2 so as to prevent a curve made by the piezoelectric element 21 and thin film 22 from oscillating in the pressure chamber 23 and to secure a sufficient ink amount for a section corresponding to the subsequent section $t_1$ and $t_2$.

Figure 4:
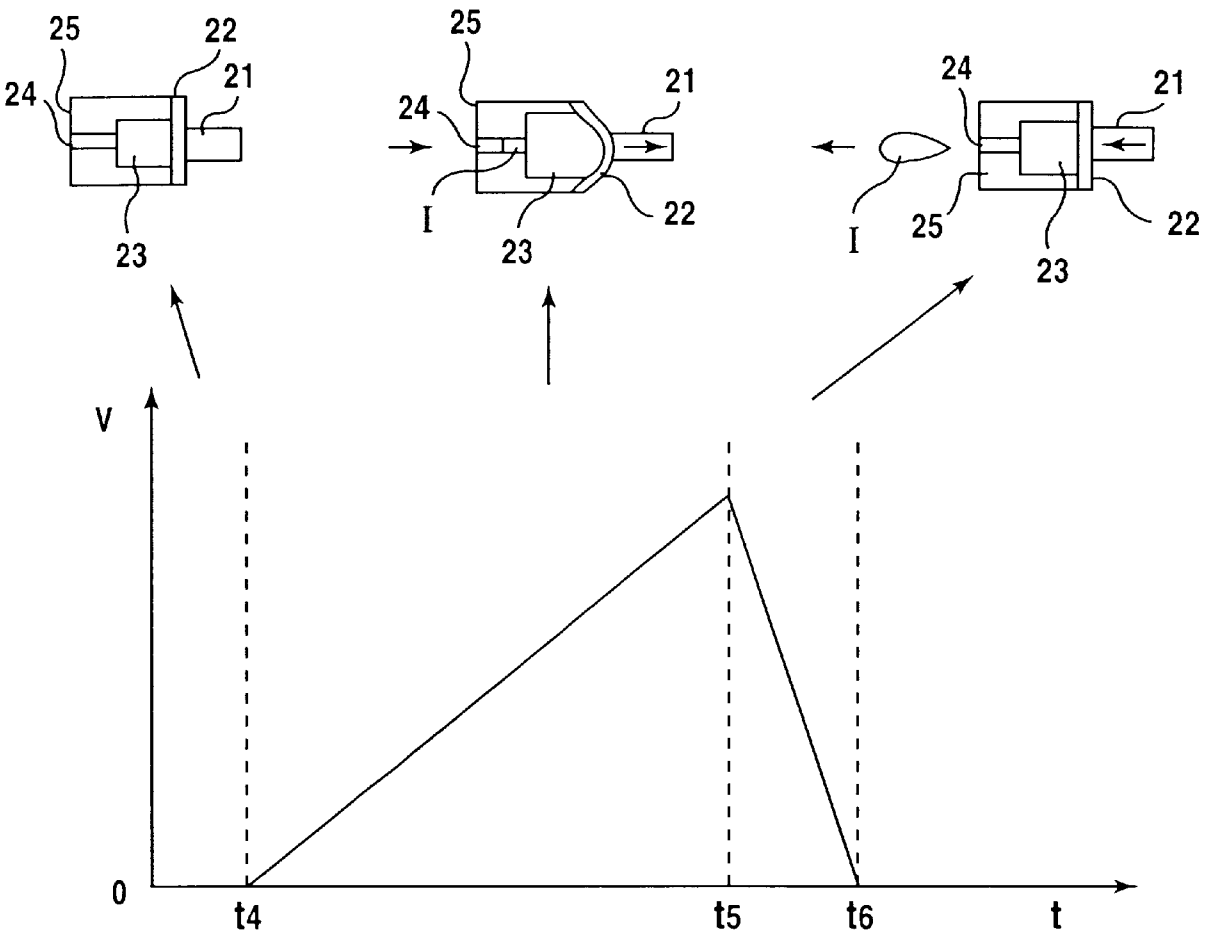
FIG. 4 is a variation of FIG. 3.

It is needless to say that the drive waveform V is not limited to a shape of a convex facing down as shown in FIG. 3. For example, the drive waveform in FIG. 3 is replaceable with a drive waveform shown in FIG. 4. Here, FIG. 4 is a variation of FIG. 3. In using the drive waveform shown in FIG. 4, a drive voltage in section between 0 and $t_4$ is zero, and thus the piezoelectric element 21 does not deform. A drive voltage applied to the piezoelectric clement 21 then increases in section between $t_4$ and $t_5$ and deforms the piezoelectric element 21. This deformation makes negative the pressure in the pressure chamber 23, and causes ink I to be supplied from the common ink chamber (not shown) to the pressure chamber 23. Lastly, a drive voltage decreases in section $t_5$ and $t_6$, and causes the piezoelectric element 21 to deform and recover its original state, thereby compressing the pressure chamber 23 via the thin film 22 and jetting ink from the nozzle 24.

Figure 5:
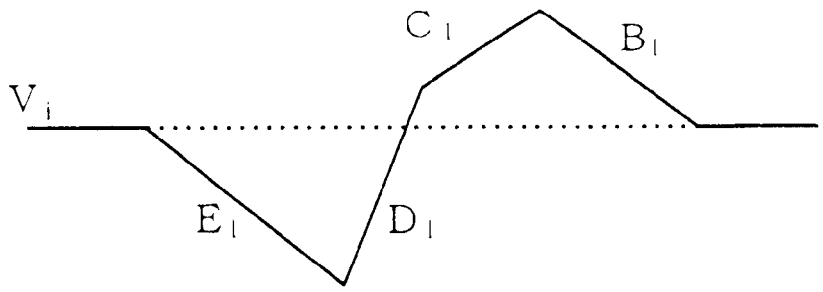
FIG. 5 is a waveform diagram showing a variation of the drive waveform in FIG. 2.
Figure 6:
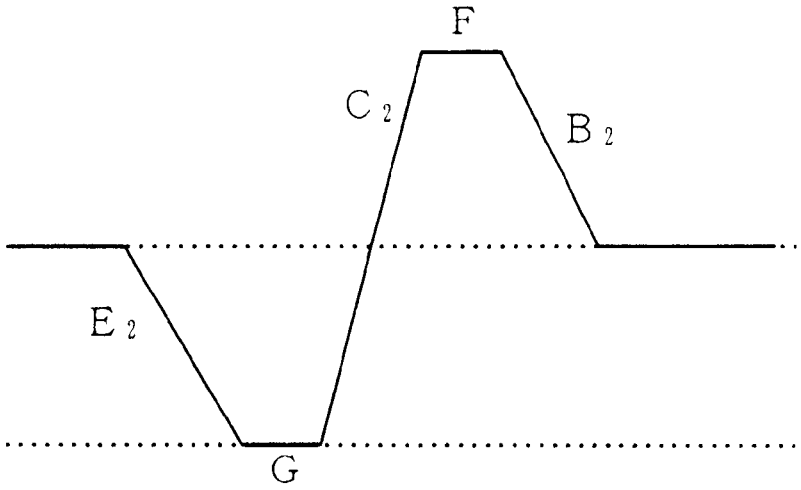
FIG. 6 is a waveform diagram showing another variation of the drive waveform in FIG. 2.

The drive waveform V is replaced with waveform V1 shown in FIG. 5 when jetting 20 pl of ink drops, or with waveform V2 shown in FIG. 6 when jetting 40 pl of ink drops. B1 and C1 in the waveform V1 correspond to parts B and C in the waveform V respectively, and thus a description thereof will be omitted. In the part $E_1$, the drive voltage decreases by degrees from the base voltage vi of, for example, 22 V to, for example, about 9 V.

Unlike the part D shown in FIG. 2, part $D_1$ need not keep small jetted ink drops, and thus continuously deforms the piezoelectric element 21. Hereby, the amount of an ink drop to be jetted becomes 20 pl, i.e., more than that shown in FIG. 2. For example, the part $D_1$ goes on increasing at a certain rate until reaching about 35 V. In FIG. 6, part $B_2$ serves, as the part B, to pull in a meniscus in order to reduce a fluctuation in ink drop amount. Part F is provided to make sharp a rear of a jet ink drop, and part G is to enlarge a leading part of a jet ink drop. Part $E_2$ serves to make shallow a meniscus in order to jet a large ink drop.

Figure 7A:
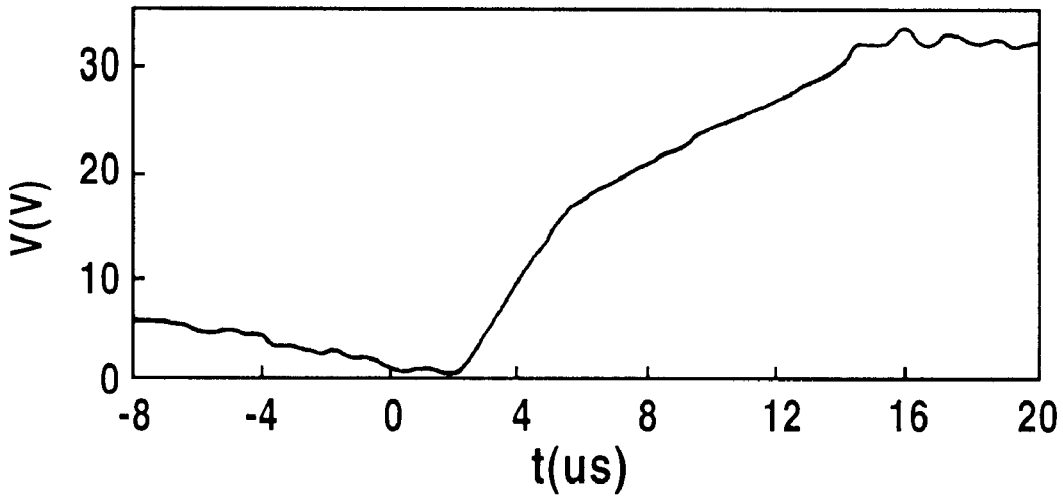
FIG. 7 is a view that shows a relationship between a drive waveform and current when only one piezoelectric element is driven in the circuit shown in FIG. 1.
Figure 7B:
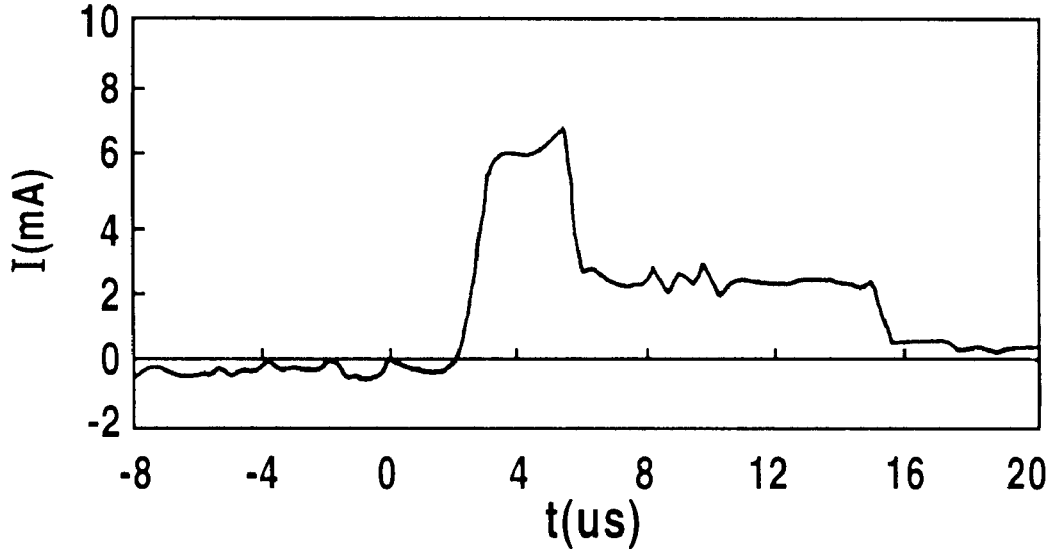

Referring to FIG. 7, a description will be given of the way of supplying one of the piezoelectric elements 21 with the drive waveform shown in FIG. 2. In this case, the control part 31*a* in FIG. 1 controls the drive waveform selection part 31*b* so that only one of drive waveform selection parts 31*b* may close and all other drive waveform selection parts 31*b* may open. FIG. 7 enlarges, in its upper view, part A in the drive waveform V shown in FIG. 2, and shows, in its lower view, current flowing through the piezoelectric element 21.

Since the piezoelectric element 21 is a capacitive load as a capacitor, it would be understood that a large current flows around t=2 (μs) where the drive voltage becomes positive, and becomes almost zero around t=16 (μs) where the drive voltage becomes approximately constant.

Figure 8A:
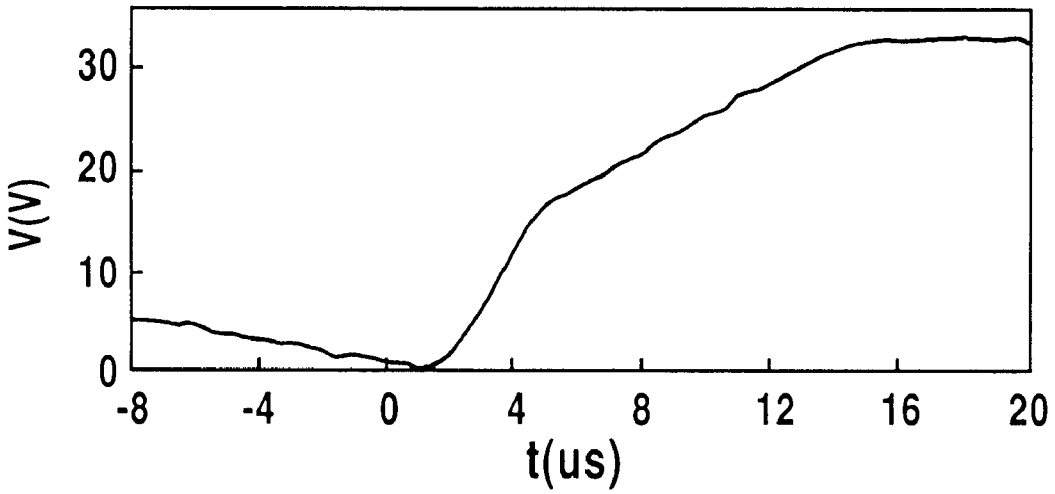
FIG. 8 is a view that shows a relationship between a drive waveform and current when 32 piezoelectric elements are driven in the circuit shown in FIG. 1.
Figure 8B:
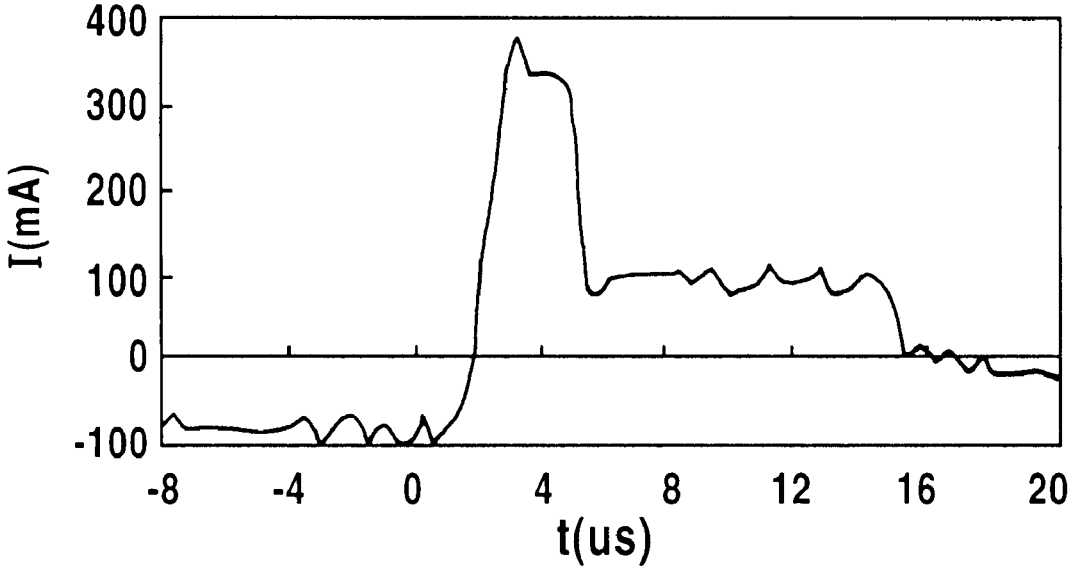

Suppose that 64 pieces of nozzles (accordingly, 64 piezoelectric elements) are, for example, mounted on the head 20 (namely, so-called 64-pin head), and 32 pieces of piezoelectric elements thereof (so-called 32-pin) are driven simultaneously. Then, the control part 31*a* controls the drive waveform selection parts 31*b* in FIG. 1 so that 32 pieces of drive waveform selection parts 31*b* may close and remaining 32 pieces may open. FIG. 8 shows such a driving state. FIG. 8 shows in its upper view a drive waveform supplied to each of the 32 piezoelectric elements 21, and in its bottom view the current that flows through each of the thirty-two piezoelectric elements 21. As shown in the upper view in FIG. 8, the drive waveform that each of the 32 piezoelectric elements receives almost maintains that shown in the upper view in FIG. 7. The current shown in the lower view in FIG. 8 corresponds to nearly 32 times as much as that shown in the lower view in FIG. 7.

Figure 9A:
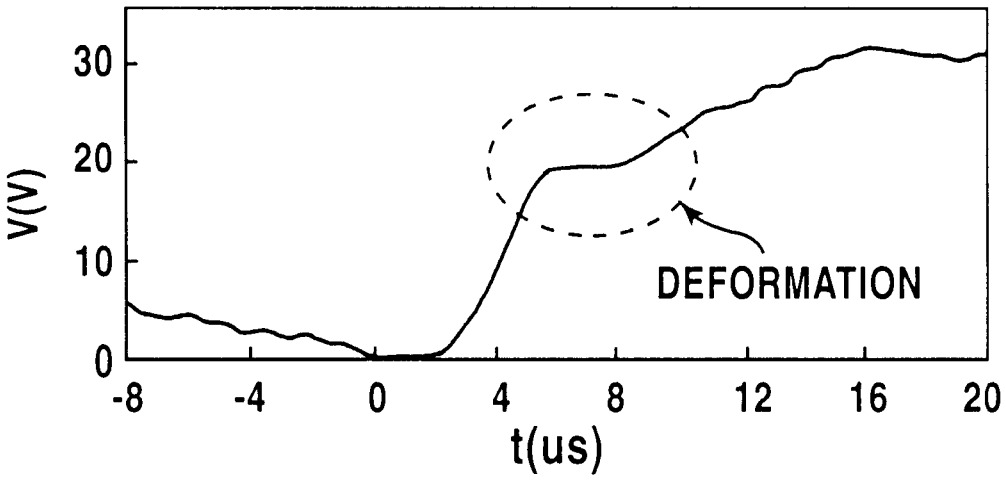
FIG. 9 is an example showing a relationship of a distorted drive waveform to a distorted current, to be compared with FIG. 8.
Figure 9B:
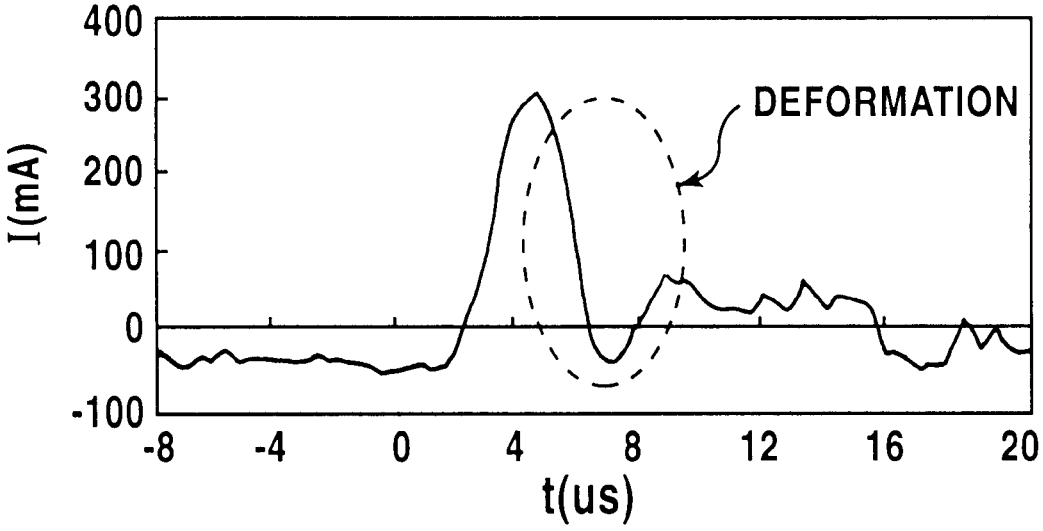

FIG. 9 shows an exemplified relationship between a distorted drive waveform and current, to be compared with FIG. 8. A deformed part, as encircled with a dotted line, would cause deteriorated images. It is understood that this invention has no such deformed parts in FIG. 8.

Figure 10:
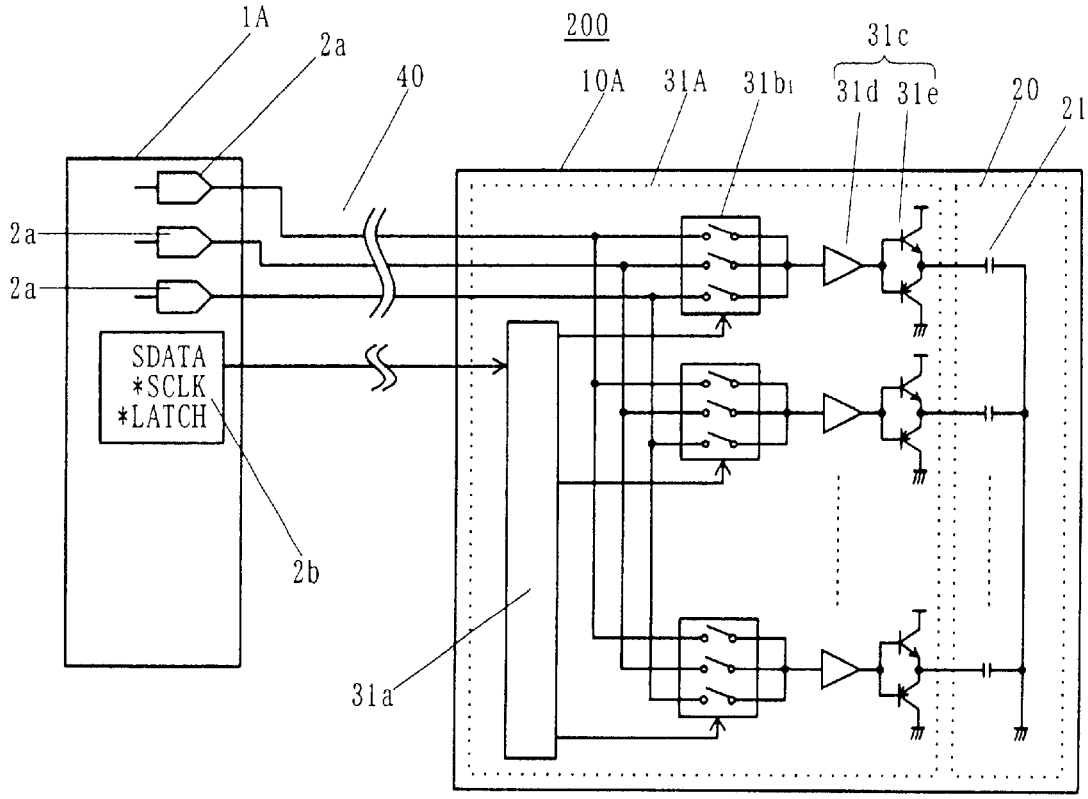
FIG. 10 is a circuit diagram showing a drive system of a second embodiment according to the present invention.

With reference to FIG. 10, a description will be given of drive system 200 of a second embodiment according to the present invention that enables the multiple-gradation printing. FIG. 10 is an exemplified configuration of a drive circuit of the present invention applied to the inkjet head 20 that can express graduations with an ink-drop size. The drive system 200 in FIG. 10 is different from the drive system 100 in FIG. 1 in that controller la has a plurality of waveform generating parts 2*a* that generate drive waveform signals for different ink amounts, and in that the head drive circuit 31A is provided rather than head drive circuit 31. In FIG. 10, three waveform generating parts 2*a* are shown for illustration purposes, but typically four to six waveform generating parts 2*a* are provided. The head drive circuit 31A is different from head drive circuit 31 in having drive waveform selection parts $\mathbf{31}b_1$ in lieu of the drive waveform selection parts 31*b*.

The drive waveform selection parts $\mathbf{31}b_1$ includes, for example, a switching element. Each drive waveform selection part $\mathbf{31}b_1$ is connected to all the waveform generating parts 2*a*, but the control part 31*a* determines which drive waveform selection part $\mathbf{31}b_1$ is selected, and which drive waveform is selected for the selected drive waveform selection part $\mathbf{31}b_1$. A configuration of multiple-gradation drive system 200 is applicable to a color inkjet head without adding any change.

The drive system 200 has effects similar to those of the drive system 100, but additionally has its own unique effects as described in the following. Firstly, the drive system 200 may employ a small-capacitance transistor for the current amplifier parts 31*e*, and may improve a frequency characteristic compared to the conventional inkjet head using a large-capacitance transistor. A multiple-gradation inkjet head requires a precise voltage value and inclination in a drive waveform, and is subject to influence by a distorted waveform more greatly than a single gradation inkjet head. The drive system 200 may thus produce higher quality images than the conventional ones.

Secondly, the conventional inkjet head has required a switching element to use a small resistance (e.g., of 100Ù or less) during an ON state so as to directly control a drive waveform through the piezoelectric element. The conventional inkjet head thus needed a large chip area, preventing a small-scale IC fabrication. On the contrary, the drive waveform 31*c* in FIG. 10 may establish input impedance higher without requiring the drive waveform selection part $\mathbf{31}b_1$ to use a switching element having a notably small resistance (for example, several 100Ù is acceptable), facilitating the small-scale IC fabrication.

Figure 11:
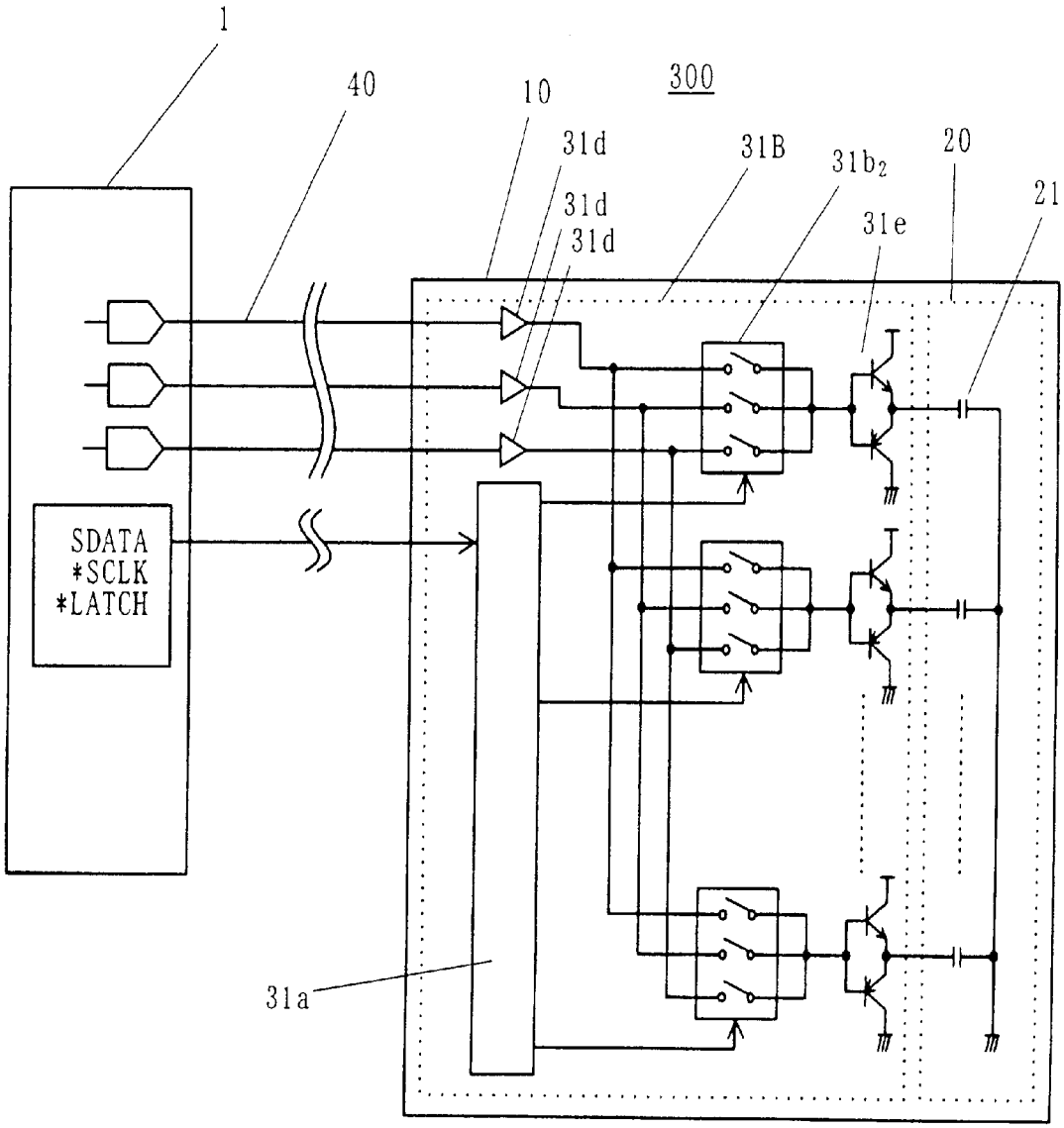
FIG. 11 is a circuit diagram showing a drive system of a third embodiment according to the present invention.

With reference to FIG. 11, a description will be given of drive system 300 of a third embodiment according to the present invention which enables a multiple-gradation printing. FIG. 11 is another example that shows a configuration of the drive circuit of the present invention applied to inkjet head 20. The drive system 300 shown in FIG. 11 reduces the number of voltage amplifier parts 31*d* by relocating the voltage amplifier parts 31*d* in head drive circuit 31A in FIG. 10 at an input side of drive circuit 31B. Each drive waveform selection part $\mathbf{31}b_2$, instead, requires a switching element to endure a high voltage. Driving a piezoelectric element needs a voltage of several dozen V to several 100 V, and requires each drive waveform selection part $\mathbf{31}b_2$ in FIG. 11 to use a switching element that may endure this voltage. On the contrary, (about several volts of) signal switching prior to voltage amplifications would be sufficient for the drive circuit 31A in FIG. 10. The gradation driving requires switching elements as many as (the number of nozzles)×(the number of gradations), and thus welcomes small and inexpensive switching elements. Since a withstand voltage and a circuit scale conflict with each other, an IC fabrication needs an appropriate selection between the structures in FIGS. 10 and 11 depending upon the semiconductor processes and integration degree to be used.

Figure 12:
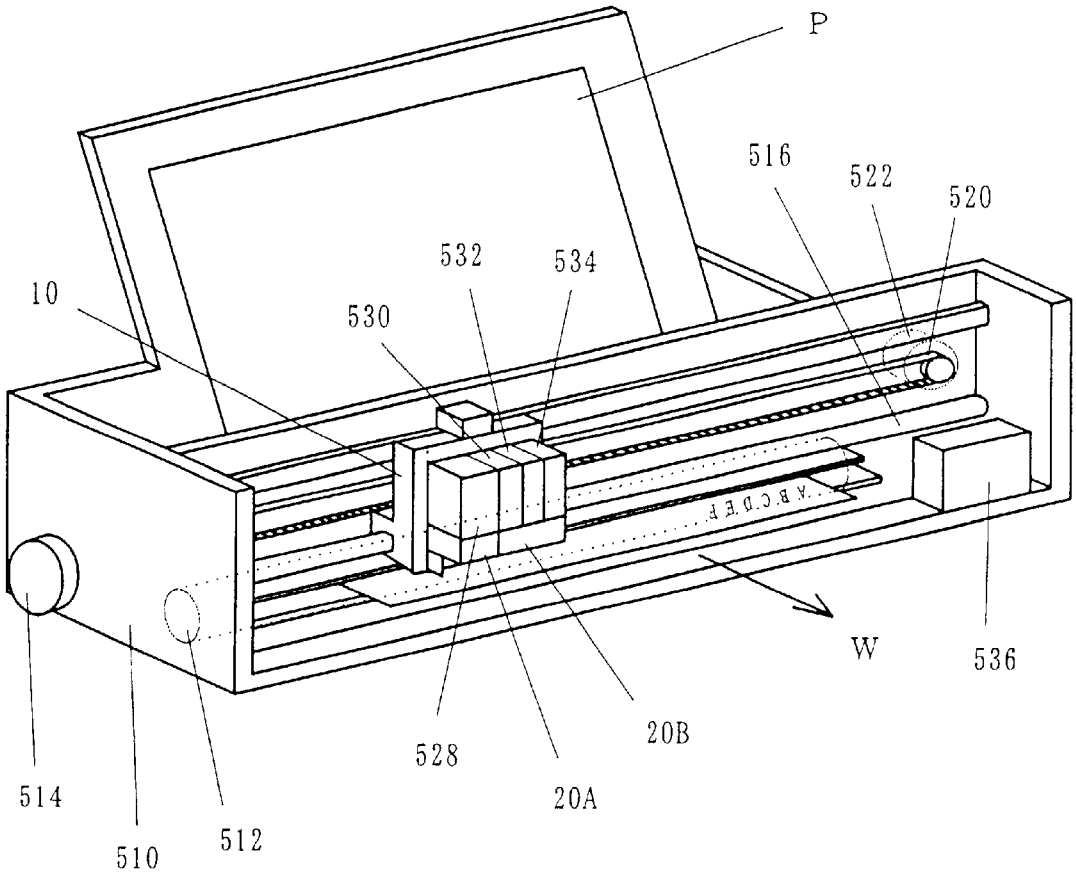
FIG. 12 is a schematic perspective view of an inkjet printer of the present invention.

With reference to FIG. 12, a description will be given of color inkjet printer 500 to which the drive system of the present invention is applicable. Referring to FIG. 12, the color printer 500 includes housing 510, platen 512 pivotally provided in the housing 510, motor 514 which drives the platen 512, guide rod 516 located parallel to the plate 512, carriage 10 attached rotatably to the guide rod 516, belt 520 and motor 522 which reciprocate the carriage 10 along the platen 12. The printer 500 further includes controller 1 on a motherboard (not shown). The controller 1 is connected to a host device (such as a personal computer, word processor, etc.) by an interface (not shown) connected to the motherboard, and also connected to the carriage 10 by the flexible cable 40 comprising a flat cable, for example.

In printing operation, the platen 512 is intermittently driven and rotated by drive motor 214, thereby intermittently feeding recording paper P by a predetermined pitch in arrow direction W. The carriage 10 includes recording head 20A for monochromatic (i.e., black-color) printing and recording head 20B for multicolor printing. The recording head 20A for monochromatic printing detachably includes black color ink tank 528, while the recording head 20B for multicolor printing detachably includes color ink tanks 530, 532 and 534. The color ink tanks 530, 532 and 534 respectively store yellow ink, cyan ink, and magenta ink.

The carriage 10 includes head drive circuit 31B or 31C (simply "31" hereinafter) comprising an IC chip (not shown), and is connected to the flexible cable 40 which is not shown in FIG. 11 and the piezoelectric elements 21 in the heads 20B and 20C which will be described later. The head drive circuit 31 is driven by the image data and control signals fed from the controller 1, thereby controlling the heads 20A and 20B and forming a predetermined image on the printing paper P while the carriage 10 moves along the platen 512. Each of these heads 20A and 20B corresponds to the head 20 in FIGS. 1, 10, and 11.

After the recording operation ends, the carriage 10 returns to a home position in which a nozzle maintenance mechanism 536 is provided. The nozzle maintenance mechanism 536 includes a movable suction cap (not shown) and a suction pump (not shown) connected to this movable suction cap. As the recording heads 20A and 20B each return to the home position, the suction cap becomes adhered to the nozzle plate in each recording head and prevents any clog in the nozzle plate by driving the suction pump.

Further, the present invention is not limited to these preferred embodiments, but various variations and modifications may be made without departing from the scope of the present invention.

What is claimed is:

1. An inkjet printer comprising:

a head which includes a plurality of piezoelectric elements and jets ink using said piezoelectric elements;

a carriage which has said head and moves with said head; and a one-chip head drive circuit, provided in said carriage, which receives a control signal and a drive signal for driving said piezoelectric elements, and drives said head, wherein said head drive circuit includes:

a plurality of selection parts, connected to each of said piezoelectric elements, which may receive said drive signal;

a control part, coupled to said selection parts, which controls said selection parts based on said control signal, and selects a piezoelectric element to be driven from among said piezoelectric elements; and a plurality of current amplifier parts, provided in every selection part and piezoelectric element, which amplify said drive signal to be supplied to said piezoelectric element to be driven, and the number of said current amplifier parts being identical to the number of said piezoelectric elements.

2. An inkjet printer according to claim 1, wherein said head drive circuit further includes a voltage amplifier part commonly coupled to said current amplifier parts.

3. An inkjet printer comprising:

a head which includes a plurality of piezoelectric elements and jets ink using said piezoelectric elements; and a head drive circuit that receives a control signal and plural types of drive signals which drive said piezoelectric elements, and drives said head, wherein said head drive circuit includes:

a plurality of selection parts, connected to each of said piezoelectric elements, which may receive each of said plural types of drive signals;

a control part, coupled to said selection parts, which controls the selection parts based on said control signal, and selects a piezoelectric element to be driven from among said piezoelectric elements and a drive signal to be used from among said drive signals; and a plurality of current amplifier parts, provided in every selection part and piezoelectric element, which amplify said drive signal to be supplied to said piezoelectric element to be driven, and the number of said current amplifier parts being identical to the number of said piezoelectric elements.

4. An inkjet printer according to claim 3, wherein said head drive circuit further includes a voltage amplifier part commonly coupled each current amplifier part.

5. An inkjet printer according to claim 3, wherein said head drive circuit comprises a one-chip IC.

6. A head drive circuit that receives a control signal and plural types of drive signals for driving piezoelectric elements and which drives the piezoelectric elements in a head, the head including said plurality of piezoelectric elements and being able to jet ink using said piezoelectric elements, and said head circuit comprising:

a plurality of selection parts, connected to each of said piezoelectric elements, which may receive each of said plural types of drive signals;

a control part, coupled to said selection parts, which controls said selection parts based on said control signal, and selects a piezoelectric element to be driven from among said piezoelectric elements and a drive signal to be used from among said drive signals; and a plurality of current amplifier parts, provided in every selection part and piezoelectric element, which amplify said drive signal to be supplied to said piezoelectric element to be driven, and the number of said current amplifier parts being identical to the number of said piezoelectric elements.

7. A head drive circuit according to claim 6, wherein said drive circuit further comprises a voltage amplifier part commonly connected to each current amplifier part.

8. A head drive circuit according to claim 6, wherein said head drive circuit comprises a one-chip IC.

9. A one-chip head drive circuit that receives control signals and a drive signal for driving piezoelectric elements in a head and which drives the piezoelectric elements, said head including said plurality of piezoelectric elements and jets ink using said piezoelectric elements, said head drive circuit comprising:

a plurality of selection parts, connected to each of said piezoelectric elements, which may receive each of said drive signals:

a control part, coupled to said selection parts, which controls said selection parts based on said control signal, and selects a piezoelectric element to be driven from among said piezoelectric elements; and a plurality of current amplifier parts, provided in every selection part and piezoelectric element, which amplify said drive signal to be supplied to said piezoelectric element to be driven, and the number of said current amplifier parts being identical to the number of said piezoelectric elements.

10. A head drive circuit according to claim 9, wherein said head drive circuit further comprises a voltage amplifier part commonly connected to each current amplifier part.

* * * * *